United States Patent [19]

Radakovich

[11] 4,065,015

[45] * Dec. 27, 1977

[54] FORK AND FRAME ASSEMBLY

[76] Inventor: Louis Radakovich, 13324 Green Drive, Chesterland, Ohio 44026

[ * ] Notice: The portion of the term of this patent subsequent to Sept. 27, 1994, has been disclaimed.

[21] Appl. No.: 858,932

[22] Filed: Sept. 18, 1969

[51] Int. Cl.[2] ..... B66F 9/00

[52] U.S. Cl. ..... 214/750

[58] Field of Search ..... 214/621, 750, 620

[56] References Cited

U.S. PATENT DOCUMENTS

| | | | |
|---|---|---|---|
| 2,581,364 | 1/1952 | Cushman | 294/67.1 |
| 2,623,775 | 12/1952 | Gamet et al. | 294/67.1 |
| 2,665,021 | 1/1954 | Wight | 214/620 |
| 2,795,347 | 6/1957 | Schenkelberger | 214/701 P |

*Primary Examiner*—Lawrence J. Oresky
*Attorney, Agent, or Firm*—Frank B. Robb

[57] ABSTRACT

The disclosure herein is of a frame assembly for use in fork lift trucks to transport and position what are known as tote boxes, the assembly being comprised of generally conventional fork members which in this instance, however, are positioned on their sides so to speak so that by connecting the ends of what are normally the upright portions of the forks together an outwardly open U-shaped frame is provided, certain frame members to connect the forks to a lift truck or the like being supplied and formed into an integral body. The construction of lift forks in this particular instance comprising a heel section which is particularly effective in resisting deformation, imparts to the U-shaped frame rigidity and resistance to spreading which is required to handle the tote boxes for which the frame is designed.

1 Claim, 4 Drawing Figures

FORK AND FRAME ASSEMBLY

OBJECTS OF THE INVENTION

The primary object of this invention is to provide a frame which is particularly suitable for handling tote boxes and specifically tote boxes formed of fiberglas material or similar material which would be normally somewhat flexible and less resistant to crushing than heavily constructed boxes, whereby the same may be raised, lowered and positioned in response to requirements for location of such boxes.

A further object of the invention is to avail of generally conventional fork members which are arranged so that they comprise a U-shaped frame, taking advantage of the inherent strength of construction of the fork members themselves, to prevent spreading of the outer extremities thereof so that a uniform spacing of such forks will make possible the engagement of the same with the lips or edges of tote boxes for moving the same.

Another object of the invention is to provide a fork and frame assembly which is of composite nature, taking advantage of relatively simple parts to provide the necessary supporting and connecting means, welding the parts together as an integral unit and to provide the frame assembly with means to connect the same removably with a fork lift truck or similar device.

Another object of the invention is to provide a fork and frame assembly as hereinbefore described, wherein a suitable shoulder is arranged along the upper surfaces, formerly the side edges of fork members, which shoulder arrangement is such as to assist in positioning the lips or edges supporting portions of tote boxes for movement by the frame assembly as may be required.

Other and further objects of the invention will be understood from a consideration of the specification appended hereto and disclosed in the drawing, wherein.

DESCRIPTION OF THE INVENTION

Figure 1:
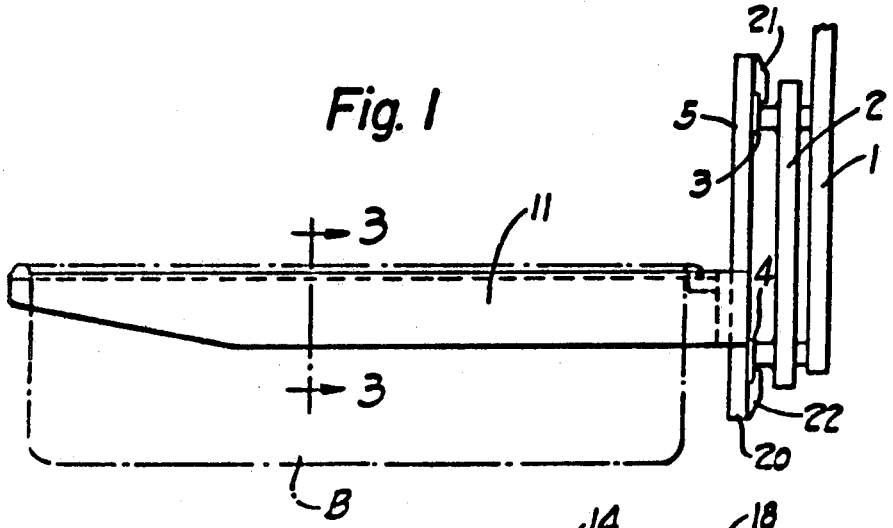
FIG. 1 is a somewhat fragmentary view, showing in side elevation a portion of a lift truck with the frame of this invention extending therefrom and in dotted lines, a tote box in position therewithin.
Figure 2:
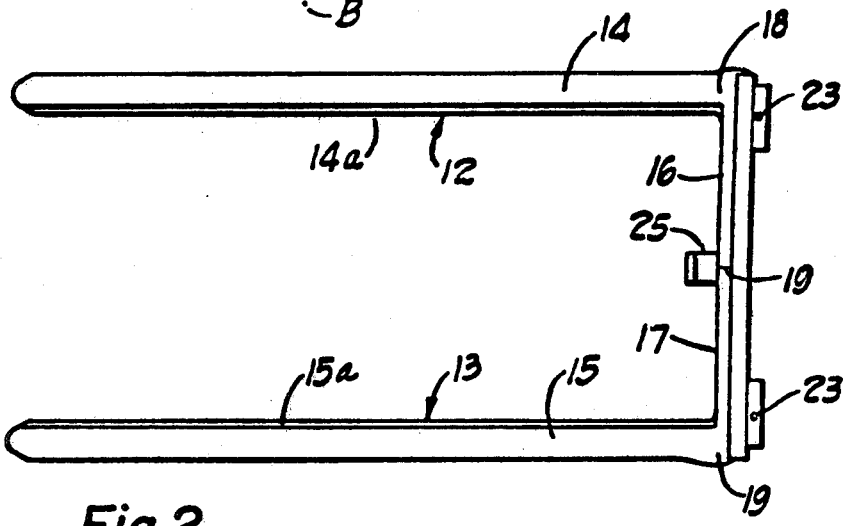
FIG. 2 is a top plan view of the fork and frame assembly of this invention.

Referring now to FIG. 1, there is shown as a fragmentary portion the lift mast 1 of a fork lift truck, not otherwise shown but readily supplied by those skilled in the art, which in turn is provided with a transverse carriage member generally designated 2, having the track portions 3 and 4 thereon which support for removable positioning the vertical frame section generally designated 5 of the fork and frame assembly of this invention.

Figure 4:
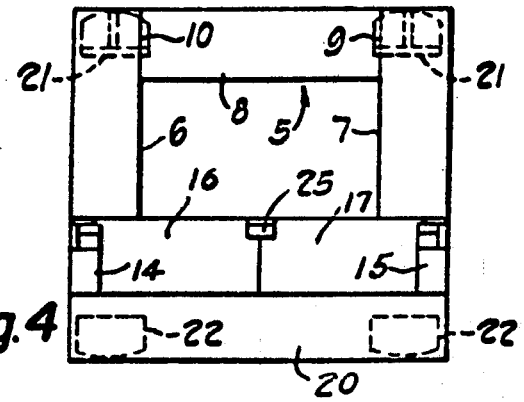
FIG. 4 is a front view, taken from the left-hand end of FIG. 1, to more particularly show the various frame members and arrangement thereof, the tote box in this instance being omitted.

Referring momentarily to FIG. 4, the frame section 5 just referred to, includes a pair of vertical frame parts 6 and 7 connected at their upper ends by a transverse cross piece 8, welded at its ends at 9 and 10 to the said members 7 and 6 respectively.

At the lower ends of the members 6 and 7 is arranged the U-shaped frame member generally designated 11, in this instance comprised of a pair of fork members 12 and 13, which include the longitudinal parts 14 and 15 respectively with what are normally vertical portions 16 and 17 respectively, the members 14 and 16 and 15 and 17 being integral and provided at their heels 18 and 19 respectively with a forged portion which is particularly effective in resisting bending and deformation which would tend to straighten the respective parts, and thus the L-shape disclosed is maintained.

The forging of these fork members is effected by an upsetting process, which in contrast to stretching the metal so to speak from an original uniform thickness at the bend, actually provides an excess amount of material so that when the bending of the portions 16 and 17 with respect to the parts 14 and 15 is effected, sufficient metal is present at the bend to provide greater strength in those areas.

Actually a sort of bulge is provided at the heels 18 and 19 as shown in the drawing, in contrast to the form of the bend if upsetting were not availed of to provide the additional metal desired.

Since the resistance to bending is increased by this construction where the fork is used in the usual manner, it will be apparent that the same increased resistance to bending will operate to prevent the forks from spreading when they are assembled on their sides as herein described for the purposes of this invention.

What are normally the vertical portions or arms of the forks 12 and 13, namely the portions 16 and 17, are in this instance laid horizontally and connected at their ends at 19 as by welding or the like.

It will thus be seen that a U-shaped frame member is thus provided, at the upper face of which arms 16 and 17 the vertical frame parts 6 and 7 are connected as by welding as indicated heretofore, which welding is the method of providing an integral frame assembly.

Beneath the arms 16 and 17 of the frame assembly now being described, is a further transverse or horizontal cross piece designated 20 which is welded to the members 16 and 17 in a conventional manner.

It will thus be seen, as viewed in FIG. 4, that a generally rectangular vertical frame 5 is provided, and to fasten this frame to the transverse carriage 2 of the fork lift truck 1, downwardly open upper hooks 21 are securely welded at the upper ends of the vertical parts 6 and 7, and upwardly open hooks 22 are welded to the cross piece 20 so as to provide a formation of members which will be securely engageable with the rails 3 and 4 previously mentioned, as extending from the carriage 2.

Suitable positioning openings such as 23 are formed in the upper hooks 21 to engage corresponding openings in the rail 3 whereby to maintain the transverse position of the assembly which is selected by the operator.

Figure 3:
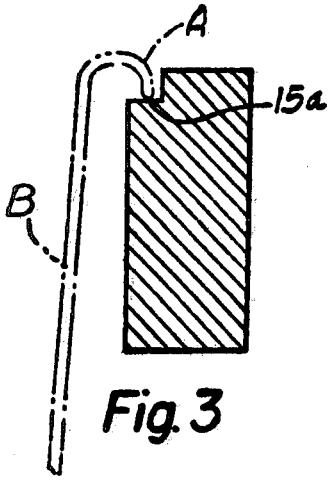
FIG. 3 is a detailed view, taken about on the line 3—3 of FIG. 1, looking in the direction of the arrows and in fragmentary form.

The arms 14 and 15 of the forks previously described are provided with shoulders such as 14*a* and 15*a* as indicated in FIG. 3, so that the lip designated A, of the tote box generally designated B may be supported thereon.

It will be observed that the tote box B is provided with this type of lip entirely around the same, the tote box being generally rectangular in plan. It will thus be also understood that the shoulders 14*a* and 15*a* maintain the tote box in proper support position during movement and positioning thereof.

Further, a hook member 25 is secured at the juncture 19 of the arms 16 and 17 to prevent undesired movement of the tote box B during transport of the same, but providing for a release of such engagement when the tote box is set down and the fork and frame assembly removed by suitable manipulation of the carriage 2 in accordance with generally conventional practice in respect to fork lift trucks.

I claim:

1. In lift frame construction of the class described, in combination, a frame, said frame including a vertical frame section having means for connection to a fork lift truck, horizontal frame means extending outwardly therefrom, said frame means comprising a pair of forks for a fork lift truck arranged in the form of a U-shaped member by connecting together the ends of the normally vertical arms thereof to constitute the cross bar of the said member, the side edges of the normally horizontal arms thereby becoming upper surfaces of the spaced arms of the said U-shaped member, the vertical frame section comprising a pair of vertical parts secured at their lower ends to the side edges of the normally vertical arms, a cross piece extending between the parts at their upper ends, downwardly open upper hooks at said ends, a cross piece connected to the lower side edges of the arms aforesaid, and upwardly open hooks on the latter for connecting the frame to such fork lift truck in cooperation with the upper hooks aforesaid.

* * * * *